US006564033B2

(12) United States Patent
Zhou et al.

(10) Patent No.: US 6,564,033 B2
(45) Date of Patent: May 13, 2003

(54) FIXING BELT AND IMAGE HEATING AND FIXING APPARATUS

(75) Inventors: Yaomin Zhou, Saitama (JP); Kazuo Kishino, Kanagawa (JP); Hideyuki Yano, Shizuoka (JP); Masahiro Suzuki, Shizuoka (JP); Kouji Sasaki, Saitama (JP)

(73) Assignees: Canon Kabushiki Kaisha, Tokyo (JP); Canon Denshi Kabushiki Kaisha, Chichibu (JP)

( * ) Notice: Subject to any disclaimer, the term of this patent is extended or adjusted under 35 U.S.C. 154(b) by 0 days.

(21) Appl. No.: 10/004,877

(22) Filed: Dec. 7, 2001

(65) Prior Publication Data

US 2002/0146259 A1 Oct. 10, 2002

(30) Foreign Application Priority Data

Dec. 12, 2000 (JP) ..... 2000-377323

(51) Int. Cl.[7] ..... G03G 15/20
(52) U.S. Cl. ..... 399/329; 219/216; 399/328
(58) Field of Search ..... 399/329, 328; 219/216

(56) References Cited

U.S. PATENT DOCUMENTS

| | | | | | |
|---|---|---|---|---|---|
| 5,568,240 | A | | 10/1996 | Ohtsuka | 355/285 |
| 5,711,804 | A | * | 1/1998 | Trench et al. | 117/4 |
| 5,765,086 | A | | 6/1998 | Kishino et al. | 399/329 |
| 5,939,337 | A | | 8/1999 | Hatakeyama et al. | 442/6 |
| 5,950,060 | A | * | 9/1999 | Isogai | 399/324 |
| 5,950,061 | A | | 9/1999 | Ota et al. | 399/333 |
| 5,974,281 | A | | 10/1999 | Fujii et al. | 399/66 |
| 6,078,780 | A | | 6/2000 | Abe et al. | 399/328 |
| 2001/0007846 | A1 | * | 7/2001 | Sakuma et al. | 492/57 |

FOREIGN PATENT DOCUMENTS

| | | | |
|---|---|---|---|
| JP | 6-222695 | | 8/1994 |
| JP | 7-13448 | | 1/1995 |
| JP | 7-114276 | | 5/1995 |
| JP | 8-302442 | * | 11/1996 |
| JP | 9-34286 | * | 2/1997 |
| JP | 9-125206 | * | 5/1997 |
| JP | 10-48976 | | 2/1998 |
| JP | 11-65335 | * | 3/1999 |

* cited by examiner

*Primary Examiner*—Quana M. Grainger
(74) *Attorney, Agent, or Firm*—Fitzpatrick, Cella, Harper & Scinto

(57) ABSTRACT

To provide a high-durable fixing belt and an image fixing apparatus with high durability and high reliability for using a heating body needing a small amount of thermal capacity to enable heating with low energy. The fixing belt according to the present invention includes at least a release layer and a metal layer made by electroforming nickel, in which the electroformed nickel has a crystal orientation ratio $1_{(200)}/1_{(111)}$ of 3 or more, in which a surface(200) is preferentially grown, and a microvickers hardness of 280 to 450.

13 Claims, 6 Drawing Sheets

FIXING BELT AND IMAGE HEATING AND FIXING APPARATUS

BACKGROUND OF THE INVENTION

1. Field of the Invention

The present invention relates to a fixing belt used in an image forming apparatus such as an electrophotographic apparatus or an electrostatic recording apparatus and an image heating and fixing apparatus for heating and fixing an unfixed image formed and carried to a recording medium.

2. Description of the Related Art

For an image forming apparatus, a fixing apparatus generally used a heat roller method in which a means for an image forming process such as an electrophotographic process, an electrostatic recording process, an electromagnetic recording process, etc. heats and fixes an unfixed image (toner image) of image information, which is to be formed and carried, to a recording medium (transfer sheet, electro fax sheet, electrostatic record, OHP sheet, printing paper, format sheet, and so on) by a transferring or direct method. This usually uses a heat source such as a halogen heater in a roller.

On the other hand, as a heating method, there is proposed and broadly used a method of heating a resin belt or metal belt needing a small amount of thermal capacity by a ceramic heater as heat source. That is, the heating method forms a nip part by interposing a heatproof belt (fixing belt) between a pressing roller as a pressing member and a ceramic heater as a heating member, introduces a recording medium, to which an unfixed toner image to be image-fixed, between the fixing belt and the pressing roller at the nip portion and carries it together with the belt so that the nip part endows the heat from the ceramic heater through the belt to the recording medium, and then fixes by heat and pressure the unfixed toner image to the surface of the recording medium by the heat and pressure of the nip part.

The fixing apparatus using the belt-heating method may constitute an on-demand type apparatus by using a member with a low amount of thermal capacity as the belt. That is, if supplying power to the ceramic heater as a heat source to generate heat to a predetermined fixing temperature only when the image forming apparatus forms the image, the apparatus has the advantages that the image forming apparatus requires short waiting time from being turned on to possibly executing the image forming (quick start ability), and the power consumption in a stand-by state is dramatically reduced (economic power consumption).

The belt heating method uses a heatproof resin as the belt, preferably a polyimide resin with a good strength and heat resistance. However, in a high-speed and high-durable machine, such resin film is not: sufficient in strength. According to that, it has been proposed to use a belt which has a substrate (base layer) made of a metal with a good strength such as SUS, nickel, aluminum, copper, etc.

In addition, Japanese Patent Application Laid-Open No. 7-114276 discloses an inducing heating method, which uses a metal belt so that it may self-heat by eddy currents caused by the electromagnetic inducement. That is, proposed is a heating apparatus to generate the eddy currents on a belt itself or a conductive member closed to the belt by the magnetic flux and generating the heat by the Joule heat. This electromagnetic inducing heating method may approach the heating area nearer to the heated member, so enhancing the efficiency of energy consumption.

To drive the fixing belt of the belt heating-type fixing apparatus, there are used a method of making a film, compressed between a pressing roller and a film guide guiding the inner surface of the belt, be driven to rotate by rotation of the pressing roller (a pressing roller driving method), and a method of, on the contrary, making the pressing roller be driven to rotate by driving an endless belt, hung down by the driving roller and a tension roller.

As examples of the fixing belt using the metal belt, Japanese Patent Application Laid-Open No. 7-13448 discloses a nickel fixing belt with a surface roughness of less than 0.5 $\mu$m and a thickness of about 40 $\mu$m, and Japanese Patent Application Laid-Open No. 6-222695 discloses a nickel fixing belt with a thickness of 10 to 35 $\mu$m, which has a release coating layer on its outer circumference and a resin layer on its inner circumference.

The nickel endless belt may be easily produced by the nickel electroforming process. Conventionally, the nickel electroforming process was used for the improvement of abrasion resistance and the brilliance for decoration, so the obtained electroformed nickel commonly contains a large amount of sulfur. In case of using the nickel electroforming to the fixing belt, it may cause a problem in durability due to the brittle at a high temperature by the effect of the sulfur.

On the other hand, Japanese Patent Application Laid-Open No. 10-48976 discloses a fixing belt having a nickel metallic layer containing not more than 0.04% by weight of sulfur and not less than 0.2% of manganese. And, in Japanese Patent No. 2706432, proposed is a fixing belt having an endless electroformed sheet with a microvickers hardness of 450 to 650, which is made of nickel-manganese alloy containing 0.05 to 0.6% by weight of manganese.

However, in case of the belt heating method, particularly using the metal belt, the heat resistance and durability are still concerned because the belt itself is carried by the rotation and repeatedly belt bending at the nip part and its gate, which easily cause mechanical fatigue.

SUMMARY OF THE INVENTION

An object of the present invention is to provide a high-durable fixing belt and an image heating apparatus with high durability and high reliability for using a heating member needing a small amount of thermal capacity to enable heating with low energy.

The fixing belt according to the present invention includes at least a release layer and a metal layer made by electroforming nickel, in which the electroformed nickel has a crystal orientation ratio $I_{(200)}/I_{(111)}$ of 3 or more, in which a surface(200) is preferentially grown, and a microvickers hardness of 280 to 450.

The fixing belt according to the present invention uses a nickel-electroformed metal layer with a good strength as a base layer, in which a crystal orientation ratio $I_{(200)}/I_{(111)}$ of the electroformed nickel is not less than 3 and a microvickers hardness is ranged in 280 to 450, whereby the fixing belt may show high durability at, particularly, high temperature. And, by using such fixing belt, an image heating apparatus with high durability and high reliability may be provided.

DESCRIPTION OF THE PREFERRED EMBODIMENTS

A fixing belt of the present invention comprises at least a release layer and a nickel-electroformed metal layer, in which the electroformed nickel has a surface(200) of which crystal is preferentially grown, the crystal orientation ratio $I_{(200)}/I_{(111)}$ is not less than 3, the microvickers hardness is 280 to 450, more preferably 330 to 420. The crystal orientation ratio $I_{(200)}/I_{(111)}$ is more preferably 8 or more. At this time, the electroformed nickel means a nickel formed by the electroforming process and its alloys.

The meaning that the surface(200) is preferentially grown is that the crystal is preferentially grown to a direction(200) parallel to the surface of a matrix. The crystal orientation ratio $I_{(200)}/I_{(111)}$ is defined as a X-ray diffraction strength ratio $I_{(200)}/I_{(111)}$ of a crystal surfaces(200) and (111). And, d value of the surface(200) is 1.7619 Å, while d value of the surface(111) is 2.0345 Å.

Conventionally, a general electroformed nickel has the structure of surface(111) preferentially grown. Owing to that, the surface may obtain the brilliance and hardness, so to be used for decoration or sliding. Therefore, the conventional fixing belt also employed the electroformed nickel with the surface(111) preferentially grown. On the contrary, the present invention uses the electroformed nickel in which the crystal is preferentially grown at the surface(200), which may improve the durability of the fixing belt. If the crystal is grown preferentially at the surface(200), it is more advantageous in flexibility, and therefore suitable for a fixing belt requiring to be bended.

In addition, if the crystal orientation ratio $I_{(200)}/I_{(111)}$ is low, though its reason is unclear, the durability is disadvantageous at a high temperature because the sulfur or organic materials caused by the brightener in an electrolytic bath become eutectoid together with the growth of the nickel crystal, and because the tissue of electroformed nickel tends to become minute crystals so that the crystals has high hardness, there may be aroused a problem in the flexibility of the belt. In the present invention, sufficient durability may be obtained by setting a crystal orientation ratio $I_{(200)}/I_{(111)}$ to be not less than 3.

In addition, this electroformed nickel has sufficient durability as a fixing belt.

And, as for semi-gloss or dull-gloss electroformed nickel, for example, an X-ray diffraction pattern of the semi-gloss or dull-gross electroformed nickel is stated in an up-to-date Surface Technology Comprehensive Bibliography, page 338 (issued by Industrial Technology Service Center Co., Ltd), which clearly mentions the surface(200) preferentially grown, but it is just specially used for such as a lower ground of the gold plating, and there is no example used in the fixing belt.

(1) The Fixing Belt 10

Now, the fixing belt of the present invention is described.

Figure 1:
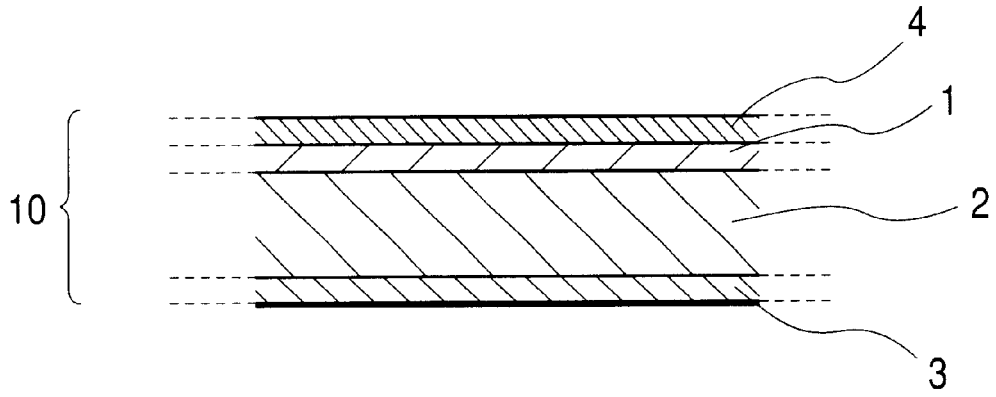
FIG. 1 shows an example of a layer construction of a fixing belt according to the present invention.

FIG. 1 shows an example of layer constructions of the fixing belt 10 of this example. The fixing belt 10 of this example has a complex structure including a metal layer 1 used as a base layer and made of an electroformed nickel endless belt, an elastic layer 2 laminated on an outer surface of the metal layer, a release layer 3 laminated on an outer surface of the elastic layer, and a sliding layer 4 laminated inside on an inner side of the metal layer 1. In the fixing belt 10, the sliding layer 4 is an inner side (toward a belt guide), while the release layer 3 is an outer side (toward a pressing roller). Between the metal layer 1 and the elastic layer 2, between the elastic layer 2 and the release layer 3, or between the metal layer 1 and the sliding layer 4, a primer layer (not shown) may be provided for adhesion. The primer layer may be a well-known one, which uses silicone group, epoxy group, polyamideimide group, and its thickness is commonly about 1 to 10 $\mu$m.

Figure 2:
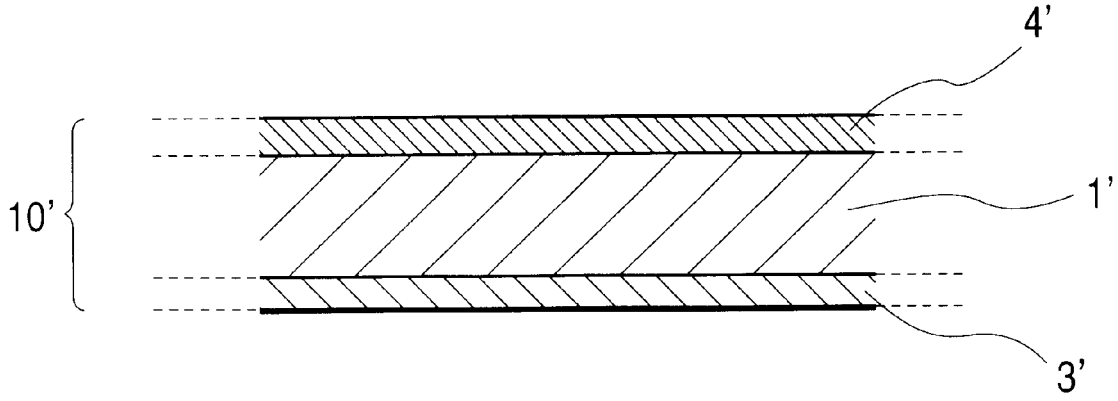
FIG. 2 shows another example of a layer construction of the fixing belt according to the present invention.

FIG. 2 shows an example of a layer configuration of a fixing belt 10' of this example. It is an example not using an elastic layer. The fixing belt 10' of this example has a complex structure including a metal layer 1' used as a base layer and made of an electroformed nickel endless belt, a release layer 3' laminated on an outer surface of the metal layer, and a sliding layer 4' laminated inside an inner side of the metal layer 1'. In the fixing belt 10', the sliding layer 4' is an inner side (toward a belt guide), while the release layer 3' is an outer side (toward a pressing roller). Between the metal layer 1' and the release layer 3', or between the metal layer 1' and the sliding layer 4', a primer layer (not shown) may be provided for adhesion. The primer layer may be identical to that of the fixing belt 10 of FIG. 1. Particularly, in case of heating and fixing a monochrome image, which needs a small amount of toner sizing on the recording medium and has relatively small irregularities on the toner layer, such a belt not using an elastic layer can be adopted.

If using this fixing belt in an electromagnetic inducing method, the metal layer 1 or 1' made of an electroformed endless belt functions as a heating layer showing the electromagnetic inducing heating characteristics. Though well described below, the alternate magnetic flux acted on the metal layer 1 or 1' causes an eddy current at the metal layer 1 or 1' so that the metal layer 1 or 1' may generate heat. The heat is applied through the elastic layer 2/release layer 3, or through the release layer 3' to the fixing belt 10 or 10', and heats the recording medium inserted in a nip part N so as to heat and fix the toner image.

In addition, the fixing belt 10 or 10' may employ a belt heating method using a ceramic heater. Though well described below, the heat of the ceramic heater is applied to the recording medium through the fixing belt 10 or 10', and the toner image is heated and fixed on the recording medium.

a. The Metal Layer 1

The metal layer 1 is made of the nickel, which is grown by the electroforming process on a surface of a matrix after digesting the pillar-shaped matrix such as SUS into an electroforming bath. This electroformed nickel has a crystal orientation ratio $I_{(200)}/I_{(111)}$ of 3 or more, in which a surface (200) is preferentially grow, and a microvickers hardness thereof is 280 to 450. The crystal orientation ratio $I_{(200)}/I_{(111)}$ is preferably not less than 8, and more preferably not less than 25.

If the hardness of the electroformed nickel is less than 280, it is not easy to handle the nickel because it is not rigid, and it is unstable on the making process, for example, generating more wrinkles due to load when taking out the nickel from the matrix. If the hardness of the electroformed nickel is more than 450, the flexibility of the belt is so decreased that it may not be suitable for the fixing belt.

The content of deposited sulfur in the electroformed nickel is preferably not more than 0.03% by weight, particularly not more than 0.02% by weight. The sulfur component of the electroformed nickel reduces electrodeposition stress, so it is an essential component to improve the shaping accuracy, while it damages flexibility or elasticity at a high temperature. It is closely related to fracture caused by the fatigue of metal. If there exists too much sulfur, the sulfur forms a thin brittle film around a nickel intercrystalline, and the intercrystalline of the electroformed nickel may be discontinuous, which tends to easily cause embrittlement fracture. If the sulfur is too insufficient, it may deteriorate the releasing from the matrix, so therefore, a lower limit of the sulfur content is 0.0001% by weight, preferably about 0.001% by weight.

The crystal orientation ratio $I_{(200)}/I_{(111)}$ closely relates to the content of the deposited sulfur and carbon, and their ratio. That is, if the content of the carbon element is not less than two times of the sulfur, it makes the surface(200) preferentially grown with the crystal orientation ratio $I_{(200)}/I_{(111)}$ not less than 3. If the content of the carbon element exceeds 0.08% by weight, the inner stress increases so that floating may be generated from the matrix, and therefore the stable crystal growth cannot be expected.

In addition, the content of the manganese in the electroformed nickel is preferably not less than 0.2 times of the weight of the sulfur content, more preferably not less than 3 times of the weight, and most preferably not more than 10 times of the weight. Adding a suitable amount of the manganese makes restraining the electroformed nickel from becoming brittle at a high temperature due to the sulfur. It is considered that this is because sulfur-manganese compound is formed at the intercrystalline of the crystal so that the generation of sulfur brittle film is restrained. If the content of the manganese is too low, it may not obtain the effect of restraining the brittle action of the sulfur. In addition, if the content of the manganese is too high, the manganese may be segregated into the nickel intercrystalline, which may cause the irrationality that the tenacity of materials is deteriorated.

If the contents of sulfur and manganese are in such ranges, it is easy to obtain a crystal pattern in which the crystal of the electroformed nickel is grown preferentially at a surface (200) and a crystal orientation ratio $I_{(200)}/I_{(111)}$ is not less than 3. In addition, if reducing the content of the sulfur, the crystal tends to grow preferentially at the surface(200)

The content of cobalt in the electroformed nickel is preferably not less than 0.1 times of the weight of the sulfur content or not more than 5 times of the weight, particularly not less than 0.2 times of the content or not more than 1.5 times of the weight. The cobalt in the electroformed nickel restrains the brittle caused by the sulfur and becomes a nucleus of the crystal. If the content of cobalt is too high, it may cause irrationality such as increase of the hardness or deterioration of tenacity due to minute crystals.

It is also preferred that the electroformed nickel contain tungsten. Its content is preferably not more than 0.5% by weight.

The electroformed nickel is, for example, made by the electroforming process with a matrix such as stainless-steel manufacture being the cathode. In this case, as the electrolytic bath, a well-known nickel electrolytic bath such as sulfamic acid group may be used, and additives such as PH conditioner, pit preventing agent, brightener, etc. may be added. For example, there can be a nickel electrolytic solution consisting of 300 to 450 g/l of sulfamic acid nickel, 0 to 30 g/l of nickel chloride and 30 to 45 g/l of boric acid. And, by controlling the temperature of electrolytic bath, cathode current density and so on, an electroformed nickel made of a desired nickel or nickel alloy can be obtained. Though it depends on the used electrolytic bath, the electroforming process is preferably carried out at an electrolytic temperature of about 45 to 60° C., a cathode current density of about 1 to 10A/dm$^2$ at common. The nickel made by the electroforming process may reduce the electrodeposition stress to improve the shaping accuracy by adding additives called as a stress reducing agent/a first brightener containing saccharin, sodium benzenesulfonate, sodium naphthalenesulfonate, and so on, and a second brightener containing 2-butyne-1,4-diol, coumarin, diethyl triamine, and so on. At this time, by adjusting the amount of the added additives, the amount of sulfur in the electroformed nickel can be in such a range, and commonly, it is preferred that about 3 ml/l to 20 ml/l is added.

The contents of deposited sulfur and carbon may be adjusted with the process condition such as the concentration and current density of brightener (saccharine, butynediol) in the bath, the bath temperature, and so on.

To add the manganese in the electroformed nickel, there is a method of putting manganese fine particles, sulfamic acid manganese, etc. into the nickel electrolyte, stirring it sufficiently and then electroplating it. The amount of the added manganese compound is, though depending on a desired composition, commonly about 10 ml/l to 40 ml/l in a previous solution state.

To add the cobalt in the electroformed nickel, there is a method of putting sulfuric acid cobalt, cobalt chloride, sulfamic acid cobalt, etc., and electroplating it with being sufficiently stirred. The amount of the added cobalt compound is, though depending on a desired composition, commonly about 5 ml/l to 30 ml/l in a previous solution state.

The thickness of the metal layer 1 is greater than a skin depth expressed in the below formula, preferably not less than 1 $\mu$m, and not more than 200 $\mu$m, particularly not more than 100 $\mu$m. The skin depth $\sigma$[m] is expressed as below by frequency f[Hz], magnetic permeability $\mu$ and specific resistance $\rho$[$\Omega$m] of an exciting circuit, $$\sigma=503\times(\rho/f\mu)^{1/2}$$

Figure 3:
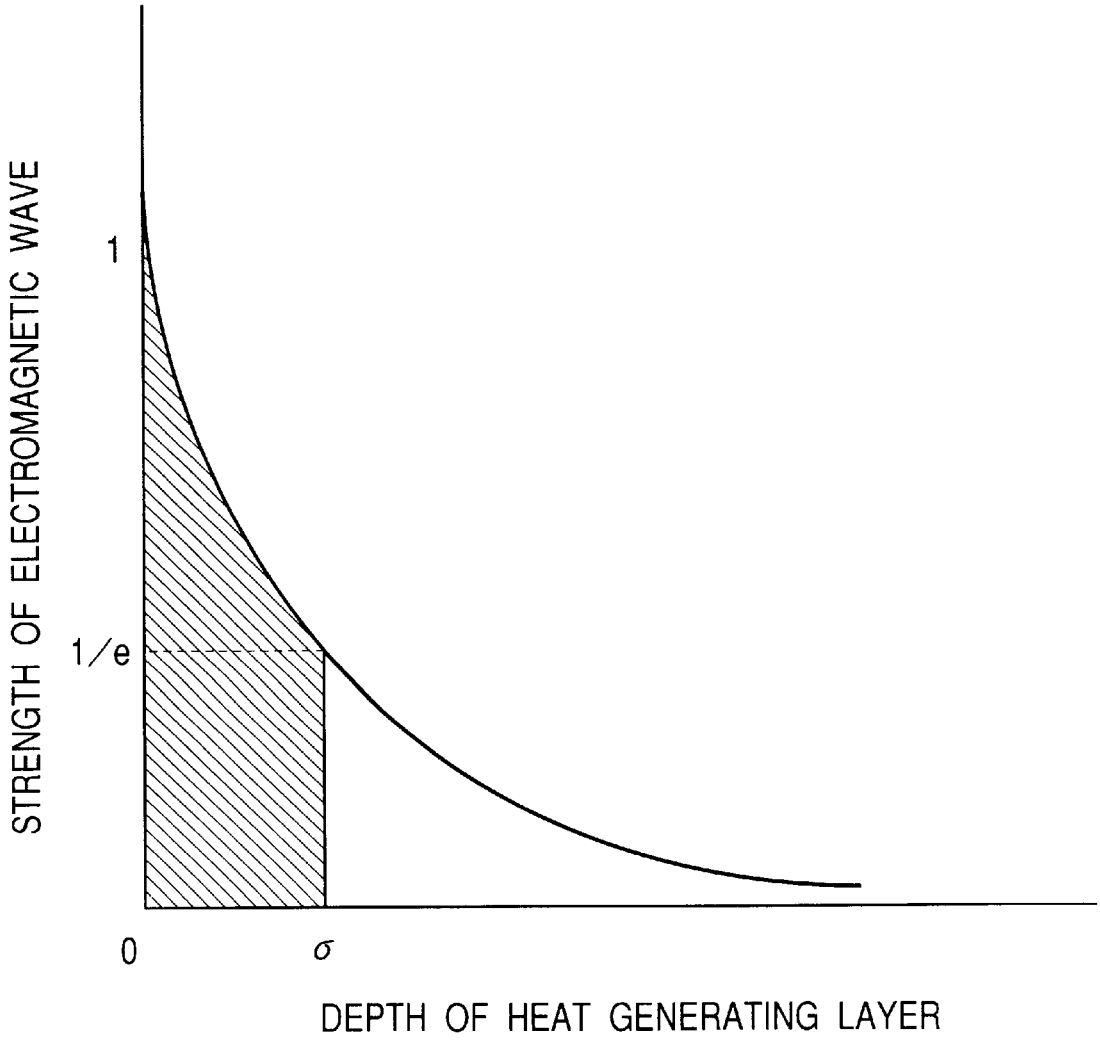
FIG. 3 shows the relation between a depth of a heating layer and strength of an electromagnetic wave.

This shows an absorbed depth of electromagnetic waves used in the electron inducement, and the strength of the electromagnetic wave at a deeper portion is not more than 1/e, and to the contrary, most energy is absorbed into such a depth (FIG. 3). If the metal layer 1 is too thin, most of electromagnetic energy is not perfectly absorbed, so decreasing the efficiency. In addition, if the metal layer 1 is too thick, the hardness is increased and the flexibility is deteriorated so that it may not be used as a rotating member. Moreover, in case of the belt heating method using the ceramic heater, it is preferred that the film thickness is not more than 100 $\mu$m, particularly not more than 50 $\mu$m or not less than 20 $\mu$m in order to improve the characteristics of quick start by reducing the thermal capacity.

The electroformed nickel used in the present invention is commonly a crystal, but it may be partially amorphous. And, the crystal is preferably not a minute crystal in view of hardness and flexibility.

The electroformed nickel having 280 to 450 of Vickers hardness HV used in the present invention has sufficient heat resistance as a fixing belt, so it is preferable that the Vickers hardness is decreased not more than 20% when it is heated to 450° C.

In addition, because the electroformed nickel has sufficient heat resistance as a fixing belt, recrystallization temperature is preferably not less than 450° C.

And, the tensile strength of the electroformed nickel at a room temperature is preferably 700 to 1500 MPa, and its elongation percentage is preferably 2 to 8%. And, because having sufficient heat resistance as a fixing belt, its characteristics are deteriorated not more than 20% when heated at 450° C.

b. The Elastic Layer 2

The elastic layer 2 may not be provided. By providing the elastic layer, it may securely transfer heat by covering the heated image on the nip part and at the same time relax the fatigue due to rotation and bending by supplementing the restitution force to the electroformed nickel belt. And, by endowing the elastic layer, it is also possible to transfer heat more efficiently by increasing follow-up of the release layer surface of the fixing belt onto an unfixed toner image surface. The fixing belt having the elastic layer 2 is suitable for a color image heating and fixing process, which needs much amount of unfixed toner to be coated.

As a material of the elastic layer 2, though not limited, it is preferable to select one with good heat resistance and heat conductivity. As the elastic layer 2, suitably selected is silicone rubber, fluorine rubber, fluorosilicone rubber or the like, and the silicone rubber is specially preferred.

As the silicone rubber used in the elastic layer, there are exemplarily polydimethylsiloxane, polymethyltrifluoropropylsiloxane, polymethylvinylsiloxane, polytrifluoropropylvinylsiloxane, polymethylphenylsiloxane, polyphenylvinylsiloxane, and copolymers of such polysiloxane.

As occasion demands, the elastic layer may contain reinforcing filler such as dry process silica or wet process silica, calcium carbonate, quartz powder, silicic acid zirconium, clay (silicic acid aluminum), talc (silicic acid magnesium containing water), alumina (aluminum oxide), colcothar (ferric oxide) and so on.

Because favorable fixed image quality is obtained, the thickness of the elastic layer 2 is not less than 10 $\mu$m, preferably not less than 50 $\mu$m, and not more than 1000 $\mu$m, preferably not more than 500 $\mu$m. In case of printing a color image, particularly a photograph image, a solid image is formed over a wide area on the recording medium P. In this case, if the heating surface (release layer 3) cannot follow the unevenness of the recording medium or the unevenness of the toner layer, there is generated the heating irregularity, so there is generated the brightness irregularity on a part with much or small heat transferred. After all, a part with much heat transferred has increased brightness, while a part with small heat transferred has decreased brightness. If the elastic layer 2 is too thin, because it cannot follow the unevenness of the recording medium or toner layer, there may generate image brightness irregularity. In addition, if the elastic layer 2 is too thick, the heat resistance of the elastic layer is increased, which may make it difficult to realize the quick start.

Because the generation of image brightness irregularity should be sufficiently restrained to obtain a good fixed image quality, the hardness (JIS-A) of the elastic layer 2 is not more than 60°, preferably not more than 45°.

The heat conductivity $\lambda$ of the elastic layer 2 is not less than $2.5\times10^{-3}$[W/cm·° C.], preferably not less than $3.3\times10^{-3}$[W/cm·° C.], and not more than $8.4\times10^{-3}$[W/cm·C], preferably not more than $6.3\times10^{-3}$[W/cm·° C.]If the heat conductivity $\lambda$ is too small, the heat resistance is increased, and so the increase of temperature at an outer surface (release layer 3) of the fixing film tends to be delayed. If the heat conductivity $\lambda$ is too high, it tends to increase the hardness or deteriorate the compression permanent distortion.

Such an elastic layer may be formed according to a conventional method, for example, a method of coating a material such as silicone rubber on a metal layer at a regular thickness with, such as, blade coating, and then heating and hardening it, a method of injecting a material such as silicone rubber in a liquid state in a mold and then vulcanizing and hardening it, a method of vulcanizing and hardening the material after the compression molding, a method of vulcanizing and hardening the material after the injection molding, and so on.

c. The Release Layer 3

The material of the release layer 3 is not limited, but selected as one with good releasing and heat resistance characteristics. As the release layer 3, fluorine resin such as PFA (tetrafluoroethylene/perfluoroalkylether compolymer), PTFE (polytetrafluoroethylene), FEP (tetrafluoroethylene/hexafluoropropylene copolymer), silicone resin, fluorosilicone resin, fluorine rubber and silicone rubber are preferred, and particularly PFA is more preferred.

And, as occasion demands, the release layer may contain a conductive agent such as carbon, tin oxide and so on in an amount not more than 10% by weight of the release layer.

The thickness of the release layer 3 is preferably not less than 1 $\mu$m or not more than 100 $\mu$m. If the release layer 3 is too thin, there may be caused the cases that a badly released portion is generated due to irregular coating of the coating film or the durability is insufficient. And, if the release layer is too thick, the heat conductivity may be deteriorated, and particularly in case of the release layer in a resin group, the hardness is increased so that the elastic layer 2 has no effect.

Such a release layer may be preferably formed according to a method of covering one, which is made into a tube by coating, drying, and plastic-deforming resin powder, dispersed as a coating, and in case of the rubber group, preferably used are a method of injecting a material in a liquid state in a mold and then vulcanizing and hardening it, a method of vulcanizing and hardening the material after the compression molding, a method of vulcanizing and hardening the material after the injection molding, and so on.

In addition, the elastic layer and the release layer may be formed at the same time by mounting a tube, of which inner surface is primer-treated, and a electroformed nickel belt, surface of which is primer-treated beforehand, to a cylindrical mold, injecting a liquid silicone rubber into a gap between the tube and the electroformed nickel belt, and then hardening and adhering the rubber by heating.

d. The Sliding Layer 4

The sliding layer 4 is not an essential element of the present invention, but preferably mounted to reduce the driving torque to operate the image heating and fixing apparatus of the present invention. If mounting the sliding layer 4, the heat generated in the heat generating layer 1 is insulated not to go to the inside of the fixing belt without the thermal capacity of the fixing belt being exceeded, so it may improve the efficiency of the heat transfer toward the recording medium P, and therefore restrain the power consumption as compared with the case no having the sliding layer 4. In addition, it may attempt to reduce the operation time.

Its material is not limited, but selected as one with high heat resistance, good strength and surface smoothness. As the sliding layer 4, polyimide resin is preferred.

And, as occasion depends, the sliding layer may contain, as a sliding agent, fluorine resin powder, graphite, molybdenum disulfide and so on.

The thickness of the sliding layer 4 is not less than 5 μm, preferably not less than 10 μm, and not more than 100 μm, preferably not more than 60 μm. If the sliding layer 4 is too thin, the durability may be insufficient. And, if the sliding layer 4 is too thick, the thermal capacity of the fixing belt may be increased so that the operating time may be elongated.

Such a sliding layer may be preferably formed by a well-known method, for example, a method of coating, drying and hardening a liquid material, or a method of adhering one, already made into a tube.

(2) Image Heating and Fixing Apparatus 100

Now, the image heating and fixing apparatus of the present invention is described. The image heating and fixing apparatus of the present invention includes a fixing belt and a pair of pressure-contacting members contacting with each other through the fixing belt, in which an inner side of the fixing belt slides with one of the pressure-contacting members, in order to heat and fix image on a recording medium by using the heat from the fixing belt, which fixing belt is the fixing belt described above. Particularly, preferably, it can be an image fixing and heating apparatus having a. magnetic flux generating means for generating magnetic flux, in which the fixing belt is heated by the magnetic flux generated in the magnetic flux generating means to heat and fix the image on the recording medium, and an image heating and fixing apparatus in which the pressure-contacting member sliding with the fixing belt is a heating member; and the image on the recording medium is heated and fixed by using the heat from the heating member through the fixing belt.

First Embodiment

Figure 4:
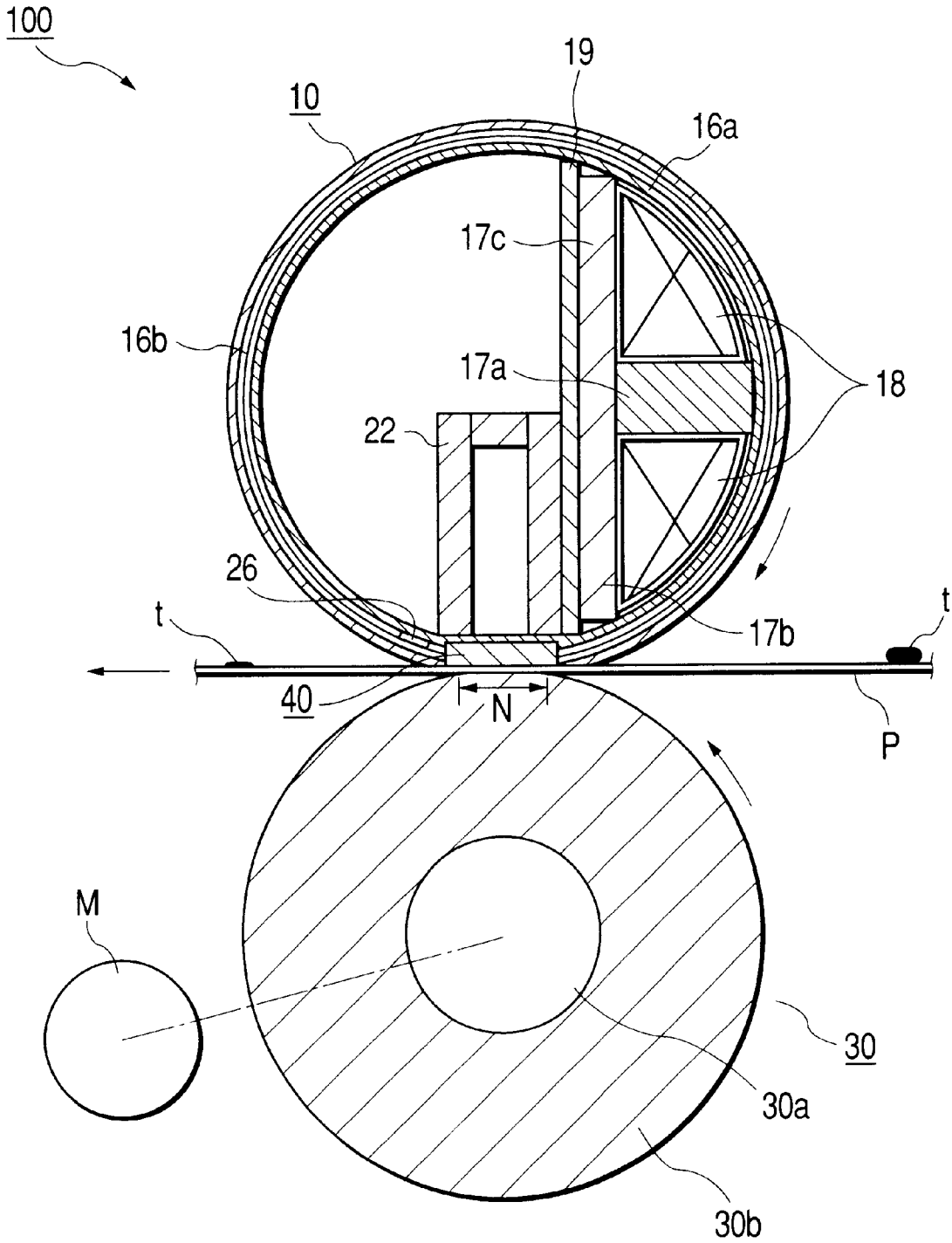
FIG. 4 schematically shows an image heating apparatus using the first embodiment.

FIG. 4 exemplarily shows a crosscut model of main parts of the image heating and fixing apparatus 100 according to this embodiment. In this embodiment, the image heating and fixing apparatus 100 is an electromagnetic inducement heating system apparatus, and the fixing belt 10 is the one described above.

Figure 5:
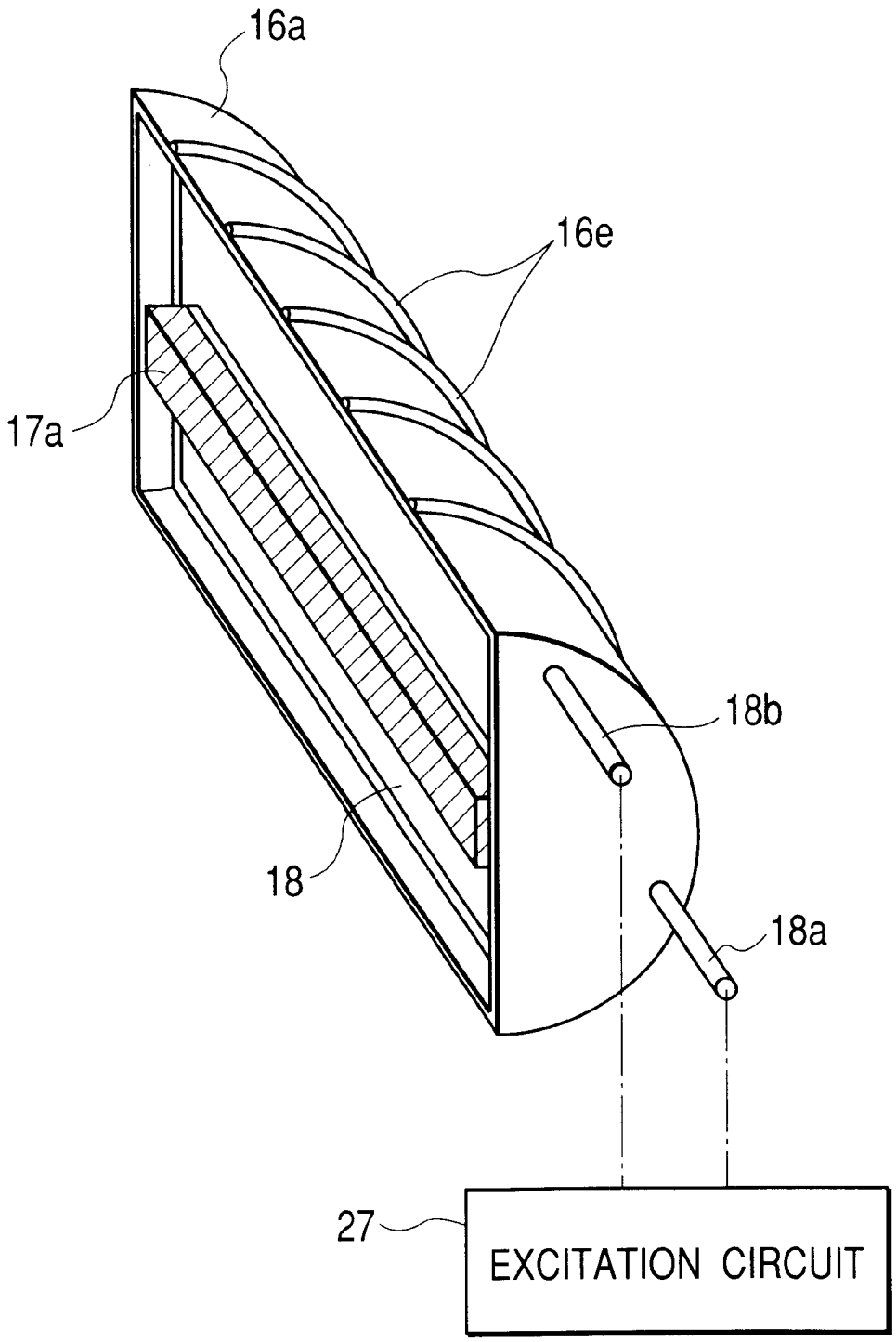
FIG. 5 shows a magnetic field generating means of the image heating apparatus using the first embodiment.

The magnetic field generating means has a magnetic core 17*a* to 17*c* and an exciting coil 18. FIG. 5 shows the magnetic field generating means of the image heating apparatus.

The magnetic core 17 is a member with high magnetic permeability, which is preferably made of a material used for a transformer core such as ferrite or Permalloy, and more preferably a ferrite with lower loss at not less than 100 kHz.

The exciting coil 18 uses several thin copper lines bound (wire bundle), each of which is made by coating an insulating material on a conducting wire (electric wire) composing a coil, and the exciting coil is formed by winding the bound wire bundle several times. In this embodiment, winding 11 turns forms the exciting coil 18.

The insulation coating preferably uses a coating with heat resistance on consideration of the thermal conductivity due to the heating of the fixing belt 10. For example, a coating made of polyimide resin, polyamideimide resin or the like can be used. At this time, it is also preferred to improve density by pressing the exciting coil 18 from outside.

Between the magnetic field generating means and the fixing belt 10, an insulating member 19 is positioned. A material of the insulating member 19 has preferably good insulation and good heat resistance. For example, there are preferably phenol resin, fluorine resin, polyimide resin, polyamide resin, polyamideimide resin, PEEK (polyetheretherketone) resin, PES (polyethersulfon) resin, PPS (polyphenylenesulfide) resin, PFA (tetrafluoroethylene/perfluoroalkylether copolymer) resin, PTFE (polytetrafluoroethylene) resin, FEP (tetrafluoroethylene/hexafluoropropylene copolymer) resin, LCP (liquid crystal polyester) resin, etc.

In the exciting coil 18, feeders 18*a* and 18*b* are connected to an exciting circuit 27. Preferably, the exciting circuit 27 may generate a high frequency wave between 20 kHz to 500 kHz by using a switching power source. The exciting coil 18 generates alternate magnetic flux by using the alternate current (high frequency current) supplied from the exciting circuit 27.

Figure 6:
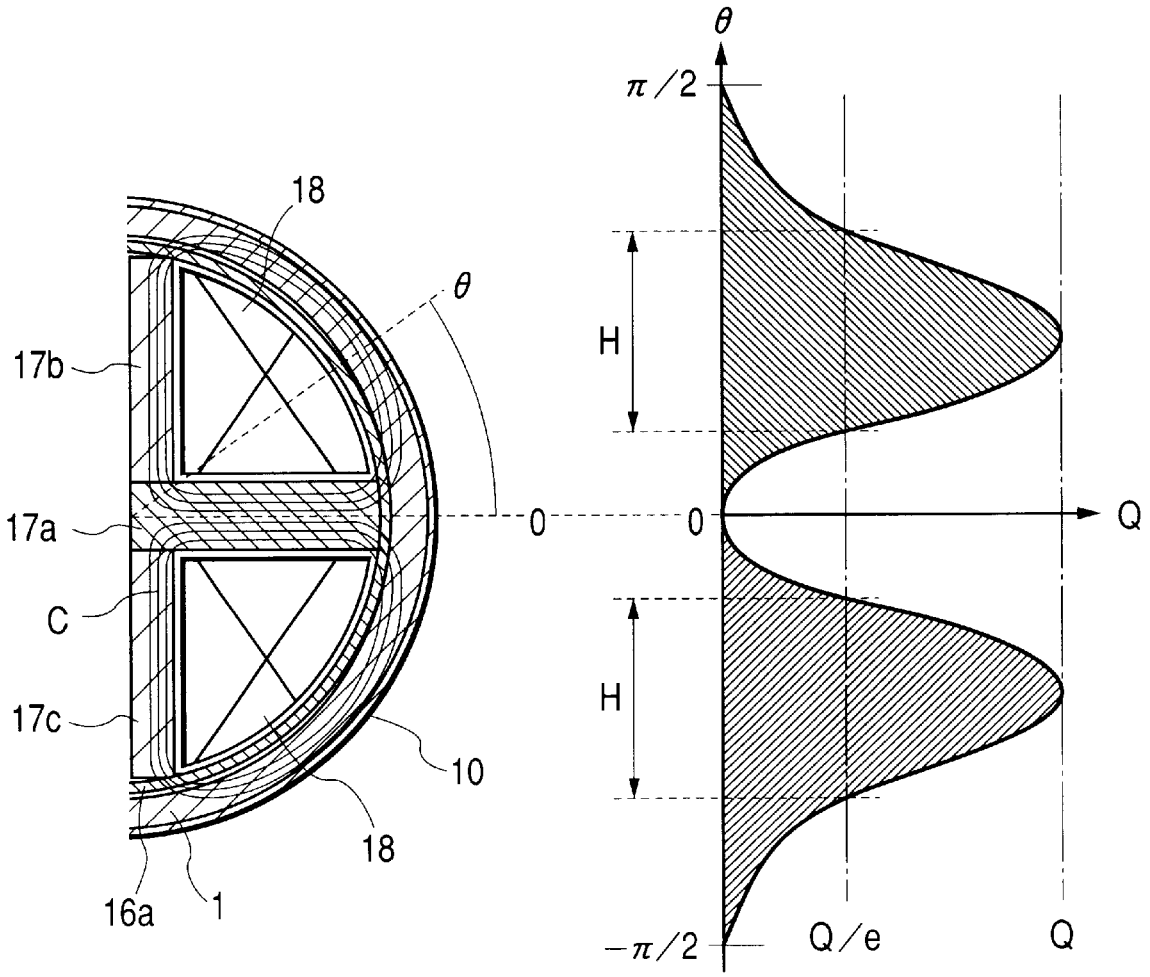
FIG. 6 shows the relation between the magnetic field generating means and the caloric power Q of the image heating apparatus using the first embodiment.

FIG. 6 schematically shows the generation state of the alternate magnetic flux. The magnetic flux C shows a part of the generated alternate magnetic flux.

The alternative magnetic flux (C) guided to the magnetic core 17 generates an eddy current at the metal layer (electromagnetic inducement heating layer) 1 made of the electroformed nickel of the fixing belt 10. This eddy current generates a joule heat (eddy current loss) at the electromagnetic inducement heating layer 1 by a specific resistance of the electromagnetic inducement heating layer 1. At this time, the calorific value Q is defined by a density of the magnetic flux passing through the electromagnetic inducement heating layer 1, and shows the distribution as shown in the graph of FIG. 4. In a right portion of the FIG. 6, a vertical axis shows a position of the electromagnetic inducement heating layer 1 as an angle θ, while a horizontal axis shows the calorific value Q at the electron inducement heating layer 1 of the fixing belt 10. At this time, if a maximum calorific value is Q, a heating area H is defined as an area where the calorific value is not less than Q/e. This is an area where a calorific value sufficient to the fixing is obtained.

This fixing nip part N can be regulated to a predetermined temperature by controlling power supply to the exciting coil 18 with use of a temperature regulator having a not-shown temperature sensing means. The temperature sensor 26 of FIG. 4 is a thermistor to detect a temperature of the fixing belt 10, and in this example, the temperature of the fixing nip part N is controlled depending on the temperature information of the fixing belt 10 measured by the temperature sensor 26.

A pressing roller 30 as a pressing member includes a core metal 30*a*, and a heat resistance elastic layer 30*b* such as a silicone rubber, a fluorine rubber, a fluorine resin and so on concentrically coated around the core metal in a roller shape, and both ends of the core metal 30*a* are positioned between chassis-side plates (not shown) to be supported by bearings so as to rotate freely.

By installing each pressing spring (not shown) by pressure between both end of pressing rigid stays 22 and spring support members (not shown) toward a apparatus chassis, pressure is exerted to the pressing rigid stays 22. By that means, a lower surface of the sliding plate 40 positioned at the lower surface of a belt guide member 16*a* and an upper surface of the pressing roller 30 contact with the fixing belt 10 by pressure to be interposed therebetween, so forming a predetermined width of the fixing nip part N. And, as the belt guide member 16, preferably used is a resin with a good heat resistance such as heat resistance phenol resin, LCP (liquid crystal polyester) resin, PPS (polyphenylene sulfide) resin, or PEEK (polyetheretherketone) resin.

The pressing roller 30 is driven to rotate counterclockwise as indicated by the arrow by a driving means M. Because the rotation of the pressing roller 30 exerts rotation force to the fixing belt 10 by the friction force between the pressing roller 30 and the fixing belt 10, the fixing belt 10 rotates out of the belt guide members 16*a* and 16*b* at a turn speed to a clockwise direction indicated by the arrow approximately corresponding to the rotation speed of the pressing roller 30 while its inner side is sliding to a lower surface of a sliding plate 40.

By such an operation, the pressing roller 30 is driven to rotate, thereby rotating the fixing belt 10', fulfilling the electromagnetic inducement heating of the fixing belt 10 as described above by electricity feeding from the exciting circuit 27 to the exciting coil 18, with controlling the temperature of the fixing nip part N to be increased to a predetermined extent, so that the recording medium P to which the unfixed toner image t carried from the image forming means is formed is induced between the fixing belt 10 and the pressing roller 30 of the fixing nip part N with its image surface looking upward, that is, facing with the fixing belt surface. And, at the fixing nip part N, the image surface is contacted with an outer side of the fixing belt 10, so to be carried to the fixing nip part N together with the fixing belt 10. In such a process, the toner image t is heated by the electromagnetic inducement heating of the fixing belt 10 so as to be heated and fixed to a surface of the recording medium P. If passing through the fixing nip part N, the recording medium P is separated, discharged and then carried from the outer side of the rotating fixing belt 10. The heated and fixed toner image on the recording medium is cooled after passing through the fixing nip part N and then becomes a permanently adhered image.

Though not installing an oil coating equipment for preventing offset to the fixing apparatus in this embodiment, it is also preferred to install the oil coating equipment in case of using a toner, which does not contain a low softening material. And, the oil coating or the cool separating may also be executed in case of using a toner containing the low softening material.

And, the pressing member 30 is not limited to such a roller, but may be another type of member such as a rotation film type so on. In addition, it is also possible to install a heating means such as the electromagnetic inducement heater to the pressing member 30 in order to supply energy to the recording medium from the pressing member 30 so that the apparatus may be constituted to heat to a predetermined temperature and control the temperature.

Second Embodiment

The fixing belt of the present invention may be preferably used in a fixing apparatus operated by a belt heating method using a ceramic heater as a heating member.

Figure 7:
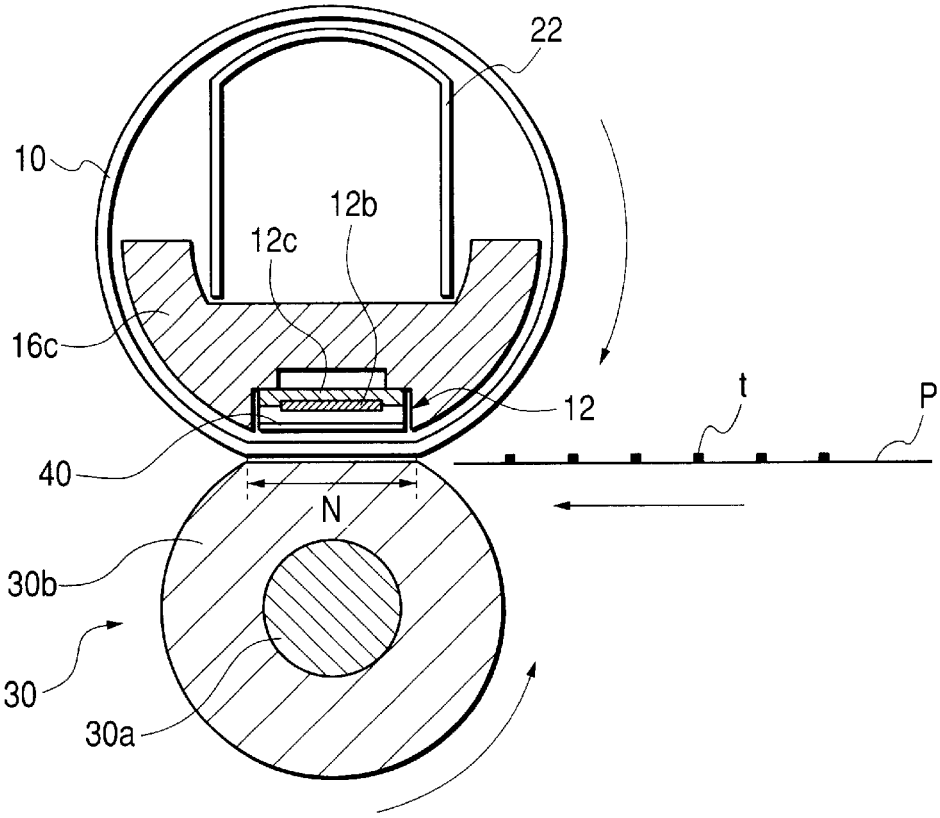
FIG. 7 schematically shows an image heating apparatus using the second embodiment.

FIG. 7 exemplarily shows a crosscut model of an image heating and fixing apparatus 100 of this embodiment. In this embodiment, the image heating and fixing apparatus 100 employs a belt heating method using a ceramic heater as a heating member, and the fixing belt 10 is identical to that of the present invention described above.

A belt guide 16*c* is a belt guide with heat resistance and insulation property. The ceramic heater 12 as a heating member is inserted and fixedly supported in a groove formed along a longitudinal direction of a guide at an approximately center portion of a lower surface of the belt guide 16*c*. And, the fixing belt 10 of the present invention in a cylindrical or endless type is loosely wound around the belt guide 16*c*.

The pressing rigid stay 22 is inserted and pierced through an inner side of the belt guide 16*c*.

The pressing member 30 is an elastic pressing roller in this embodiment. This pressing member 30 has lowered the hardness by mounting an elastic layer 30*b* such as silicone rubber to the core metal 30*a*, both ends of which core metal 30*a* are positioned between chassis-side plates (not shown) to be supported by bearings so as to rotate freely. In order to improve a surface property, the elastic pressing roller may include a fluorine resin such as PTFE (polytetrafluoroethylene), PFA (tetrafluoroethylene/perfluoroalkylether copolymer), FEP (tetrafluoroethylene/hexafluoropropylene copolymer) and so on at its outer circumference.

As for the pressing means to form the fixing nip part N and the support means at an end of the fixing film, they have configuration identical to the first embodiment.

The pressing roller 30 is driven to rotate counterclockwise as indicated by the arrow by a driving means M. Because the rotation of the pressing roller 30 exerts rotation force to the fixing belt 10 by the friction force between the pressing roller 30 and an outer side of the fixing belt 10, the fixing belt 10 rotates out of the belt guide members 16*c* at a turn speed to a clockwise direction indicated by the arrow approximately corresponding to the rotation speed of the pressing roller 30 while its inner side is sliding to a lower surface of a sliding plate 40 (a pressing roller driving method).

According to a printing start signal, the pressing roller 30 starts to rotate, and the ceramic heater 12 starts to be heated up. The rotation turn speed of the fixing belt 10 is normalized by the rotation of the pressing roller 30, and with the temperature of the ceramic heater 12 being increased to a predetermined extent, the recording medium P to which the toner image t is carried as a heated material between the fixing belt 10 and the pressing roller 30 at the fixing nip part N, is induced with the toner image carried surface toward the fixing belt 10. And, the recording medium P is contacted to a lower side of the ceramic heater 12 through the fixing belt 10 at the fixing nip part N, so as to move to pass through the fixing nip part N together with the fixing belt 10. In the passing process, the heat of the ceramic heater 12 is endowed to the recording medium P through the fixing belt 10, and then the toner image t is heated and fixed to the surface of the recording medium P. The recording medium P passing through the fixing nip part N is then separated from an outside of the fixing belt 10 and carried.

The ceramic heater 12 as a heating member is a long linear heating member with a lower thermal capacity, of which longitudinal direction is a direction rectangular to a moving direction of the fixing belt 10 and the recording medium P. It basically includes a heater substrate 12*a* formed with such as aluminum nitride, a heating layer 12*b* mounted at a surface of the heater substrate 12*a* along its longitudinal direction, a heating layer 12*b* made by coating an electric resistant material such as Ag/Pd (Silver/Palladium) with about 10 $\mu$m and 1 to 5 mm of width by such as screen printing, and a protective layer 12*c* such as glass or fluorine resin mounted thereon. However, the used ceramic heater is not limited to that case.

And, by electric current between both edges of the heating layer 12*b* of the ceramic heater 12, the heating layer 12*b* is heated so that the heater 12 rapidly increases its temperature. The temperature of this heater is detected by a temperature sensor (not shown), and a control circuit (not shown) controls the electric current toward the heating layer 12*b* so as to maintain the heater at a predetermined temperature, so that the heater 12 may control and manage its temperature.

The ceramic heater 12 is inserted and fixedly supported in a groove formed along a longitudinal direction of a guide at an approximately center portion of a lower surface of the belt guide 16*c* in the upward of the protective layer 12*c* side. At the fixing nip part N contacting with the fixing belt 10, a surface of the sliding member 40 of the ceramic heater 12 and an inner side of the fixing belt 10 are sliding in contact.

And, it is also possible to install a ferromagnetic metal plate such as a steel plate instead of the ceramic heater, and heat the ferromagnetic metal plate by the electromagnetic inducement used in the first embodiment, so as to be used as a heater.

In addition, the pressing material 30 is not limited to the roller member, but other types of member such as a rotating film may be used. Moreover, it is also possible to install a heating means such as the electromagnetic inducement heater to the pressing member 30 to supply thermal energy to the recording medium from the pressing member 30, so as to be heated for controlling temperature.

Other Embodiments

The configuration of the image heating and fixing apparatus is not limited to the pressing roller driving method as described in those above embodiments.

Figure 8:
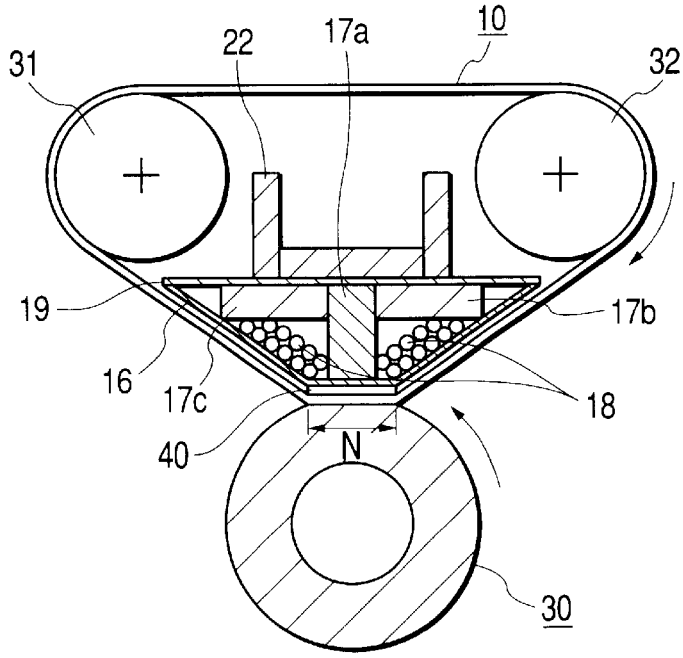
FIG. 8 is a schematic view of image heating apparatus using other embodiments.

Besides, for example, it is possible to install the fixing belt 10 of the present invention between the belt guide 16 and a driving roller 31 and a tension roller 32 as shown in FIG. 8, and form the fixing nip part N by interposing the fixing belt 10 between a lower side of the belt guide 16 and the pressing roller 30 as a pressing member to be in contact by pressure so that the fixing belt 10 may be driven to rotate by the driving roller 31. In this case, the pressing roller is the follow up rotating roller.

And, in this case also, the pressing member 30 is not limited to a roller member, but can be a member of any other type such as a rotating film. Moreover, it is also possible to install a heating means such as the electromagnetic inducement heater to the pressing member 30 so that the pressing member 30 may also supply thermal energy to the recording medium, so as to be heated for controlling temperature.

The image heating apparatus of the present invention is not limited to the image heating and fixing apparatus, but can be used as an image heating apparatus for improving the surface characteristics such as gloss by heating the recording medium carrying an image, or an image heating apparatus for temporary fixing image. Besides, it can be broadly used to heat the recording medium such as a heating and drying apparatus of the recording medium, a heating laminate apparatus.

EXAMPLES

Embodiment 1

Various fixing belts were prepared by selecting an electroformed nickel endless belt with inside diameter of 34 mm and thickness of 50 $\mu$m as shown in the below Table as the metal layer 1, and laminating a silicone rubber of 300 $\mu$m as the elastic layer 2 and PFA tube of 30 $\mu$m as the release layer 3 with the primer being interposed, and in which the polyimide resin layer as the sliding layer 4 has a thickness of 15 $\mu$m.

At first, in the electrolytic bath, after making a solution bath containing 450 g/l of sulfamic acid nickel tetrahydrate, 10 g/l of nickel chloride, and 40 g/l of boric acid and then adding a required amount of pit preventing agent, saccharine, 2-butyne-1,4-diol were added as a brightener as shown in the below Table 1. And, as additives, sulfamic acid manganese solution (50% by weight) and cobalt chloride solution (50% by weight) were added as much as the amounts shown in the below Table 1, then processing electrolytic refining with low current during filtering it in a vessel filled with activated carbon. By using the obtained various nickel electrolytic bathes, a matrix made of stainless steel was set to the cathode, and then the electroformed nickel with an inside diameter of 34 mm and a thickness of 50 $\mu$m was formed by executing the nickel electroforming at various electrolytic bath temperatures and cathode current densities shown in the below Table 1. And, the electroformed nickel was separated and used as the metal layer.

TABLE 1

| | Bath composition | | | | | |
|---|---|---|---|---|---|---|
| | | | Additives | | | |
| | Brightener | | Sulfamic Acid | Cobalt | Process condition | |
| | Saccharine (g/l) | Butyne diol (g/l) | manganese solution (ml/l) | chloride solution (ml/l) | Bath temp. (° C.) | Current density (A/dm$^2$) |
| Example 1 | 0.05 | 0.6 | 0 | 0 | 53 | 3 |
| Example 2 | 0.03 | 0.4 | 0 | 0 | 53 | 3 |
| Example 3 | 0.02 | 0.2 | 0 | 0 | 53 | 3 |
| Example 4 | 0.04 | 0.7 | 10 | 1 | 53 | 2.5 |
| Example 5 | 0.03 | 0.5 | 10 | 1 | 53 | 2.5 |
| Example 6 | 0.04 | 0.4 | 1 | 5 | 53 | 1.5 |
| Example 7 | 0.07 | 0.8 | 1 | 5 | 53 | 1.5 |
| Example 8 | 0.04 | 0.4 | 10 | 1 | 53 | 4 |
| Example 9 | 0.02 | 0.1 | 0 | 0 | 53 | 7 |
| Example 10 | 0.08 | 0.4 | 0 | 0 | 53 | 1 |
| Comparative example 1 | 0.06 | 0.4 | 20 | 0 | 53 | 3.5 |
| Comparative example 2 | 0.06 | 0.3 | 40 | 0 | 53 | 7 |
| Comparative example 3 | 0.3 | 1.2 | 0 | 0 | 53 | 7 |
| Comparative example 4 | 0.3 | 1.2 | 0 | 30 | 53 | 7 |
| Comparative example 5 | 0.3 | 1.5 | 0 | 0 | 53 | 3 |
| Comparative example 6 | 0.06 | 0.1 | 0 | 0 | 53 | 3 |
| Comparative example 7 | 0 | 0.3 | 0 | 0 | 53 | 3 |
| Comparative example 8 | 0.04 | 0.8 | 0 | 0 | 53 | 3 |

The crystal orientation ratio $I_{(200)}/I_{(111)}$ of the electroformed nickel obtained, after measuring X-ray diffraction strength of the surface(200) (d value=1.7619 Å) and the surface(111) (d value=2.0345 Å) by the X-ray dispersion diffraction method with use of X-ray diffraction apparatus RAD-3R manufactured by Rigaku Denki Corporation, was calculated by the ratio.

The content of sulfur, manganese and cobalt in the electroformed nickel was determined by quantitative analysis according to inductively coupled plasma-atomic emission spectroscopy (ICP-AES). The inductively coupled plasma-atomic emission spectroscopy is a method that the quantity of an element is determined by measuring the strength of emission ray corresponding to the wavelength of the emitted photon at the time of returning the thermally excited atom (or ion) to low energy level.

The content of a carbon in the electroformed nickel was determined by combustion-infrared absorption method. The combustion-infrared absorption method is a method that the sample is put into a magnetic crucible, a combustion improver is added, the sample is burned in an oxygen atmosphere by high frequency inducing heating or electric resistance heating and sufficiently oxidized to transfer C in the sample into $CO_2$, combustion gas is passed through infrared detector, the absorption amount of the infrared ray by $CO_2$ is measured, and the amount measured is compared with the measuring value of the standard sample to carry out the determination of the quantity of C. Its result is shown in the Table 2.

Except the comparative examples 7 and 8, various kinds of electroformed nickel were obtained. The comparative example 7 cannot be used in the test because transformation occurs in releasing (separated from the mold). It is because the finished hardness is low and the strength is insufficient. The comparative example 8 cannot be tested because the thickness of the finished film is irregularly distributed. It is because the floating occurs between the crystal and the matrix during the crystal growing due to high inner stress.

Next, the primer layer was formed by coating the primer (DY35•051 manufactured by Dow Corning Toray Silicone Co., Ltd.) with use of a spray, and drying it for 30 minutes at 150° C. Its thickness is 5 μm.

Then, the primer layer was also formed at an inside of PFA tube, coaxially mounting it together with the metal layer at a cylindrical mold having an inside diameter approximately identical to an outside diameter of PFA tube, injecting a liquid silicone rubber (DY32•561A/B manufactured by Dow Corning Toray Silicone Co., Ltd.) between the tube and the metal layer, and then heating it in a warm air circulating hearth for 30 minutes at 200° C. The vulcanization of the rubber and other adhesion were carried out at the same time, and the silicone rubber with a thickness of 300 μm as an elastic layer 2 and PFA tube with a thickness of 30 μm as a release agent 3 were laminated on the metal layer.

And, polyimide varnish (U-Varnish S manufactured by Ube Industries, Ltd.) was coated on an opposite side to the metal layer, drying and vulcanizing it in the warm air circulating hearth for 1 hour at 210° C., and then laminated the polyimide resin layer with a thickness of 15 μm as the sliding layer 4.

In addition, such a fixing belt constructed as above was installed to the image heating and fixing apparatus 100 of an electromagnetic inducement heating method, and used to the idle durability test.

Idle Durability Test

With controlling the temperature at 220° C., the pressing roller was contacted with the fixing belt by a predetermined pressure, and the fixing belt was driven by the pressing roller to follow up rotate. As the pressing roller, used was a rubber roller with an outer diameter of 30 mm, in which PFA tube of 30 μm is coated on the silicone layer with a thickness of 3 mm. In this test, the pressing force was set to 200 N, the fixing nip was 8 mm×230 mm, the surface speed of the fixing belt was 100 mm/sec. By using each fixing belt in the rotation test, the durable time was defined the time taking till crack or fracture occurs in the belt.

TABLE 2

| | Crystal orientation ratio | Hardness | S (wt %) | C (wt %) | (C/S) | Mn (wt %) | (Mn/S) | Co (wt %) | (Co/s) | Durability time (Hr) |
|---|---|---|---|---|---|---|---|---|---|---|
| Example 1 | 40 | 420 | 0.02 | 0.07 | 3.5 | 0 | 0.0 | 0 | 0.0 | 600 |
| Example 2 | 80 | 370 | 0.01 | 0.04 | 4.0 | 0 | 0.0 | 0 | 0.0 | 710 |
| Example 3 | 70 | 330 | 0.005 | 0.02 | 4.0 | 0 | 0.0 | 0 | 0.0 | 690 |
| Example 4 | 50 | 400 | 0.02 | 0.06 | 3.0 | 0.08 | 4.0 | 0.01 | 0.5 | 680 |
| Example 5 | 50 | 360 | 0.01 | 0.04 | 4.0 | 0.08 | 8.0 | 0.01 | 1.0 | 610 |
| Example 6 | 20 | 400 | 0.02 | 0.05 | 2.5 | 0.01 | 0.5 | 0.08 | 4.0 | 500 |
| Example 7 | 10 | 440 | 0.03 | 0.07 | 2.3 | 0.01 | 0.3 | 0.06 | 2.0 | 400 |
| Example 8 | 8 | 330 | 0.01 | 0.03 | 3.0 | 0.09 | 9.0 | 0.01 | 1.0 | 600 |
| Example 9 | 40 | 280 | 0.003 | 0.01 | 3.3 | 0 | 0.0 | 0 | 0.0 | 350 |
| Example 10 | 3 | 420 | 0.025 | 0.06 | 2.4 | 0 | 0.0 | 0 | 0.0 | 310 |
| Comparative example 1 | 1 | 390 | 0.02 | 0.02 | 1.0 | 0.3 | 15.0 | 0 | 0.0 | 170 |
| Comparative example 2 | 1 | 400 | 0.02 | 0.01 | 0.5 | 0.5 | 25.0 | 0 | 0.0 | 100 |
| Comparative example 3 | 0.2 | 600 | 0.08 | 0.08 | 1.0 | 0 | 0.0 | 0 | 0.0 | 10 |
| Comparative example 4 | 0.3 | 620 | 0.08 | 0.08 | 1.0 | 0 | 0.0 | 1.2 | 15.0 | 30 |
| Comparative example 5 | 0.8 | 640 | 0.08 | 0.1 | 1.3 | 0 | 0.0 | 0 | 0.0 | 40 |
| Comparative example 6 | 0.5 | 400 | 0.01 | 0.005 | 0.5 | 0 | 0.0 | 0 | 0.0 | 80 |
| Comparative example 7 | — | 260 | 0 | 0.03 | — | 0 | 0.0 | 0 | 0.0 | — |
| Comparative example 8 | — | 420 | 0.01 | 0.1 | 10.0 | 0 | 0.0 | 0 | 0.0 | — |

In case of using the fixing belt of the present invention having the crystal orientation ratio $I_{(200)}/I_{(111)}$ not less than 3 and microvickers hardness 280 to 450, the durability time is all more than 300 hours. Among them, those having the crystal orientation ratio $I_{(200)}/I_{(111)}$ not less than 8 were confirmed that the durability time is all more than 400 hours. In the fixing belt of the present invention having microvickers hardness 330 to 420, the durability time is all more than 400 hours. To the contrary, in case of using the fixing belt of the comparative examples having the crystal orientation ratio $I_{(200)}/I_{(111)}$ less than 3, any of them does not exceed 200 hours of the durability time. And, it is also validated that all of fixing belts in which a crystal orientation ratio $I_{(200)}/I_{(111)}$ is not less than 8, the content of the sulfur is not more than 0.02% by weight, the content ratio (weight ratio) of the manganese to that of sulfur is 3 to 10, and the content ratio (weight ratio) of cobalt to that of sulfur is not more than 1, have durability exceeding 600 hours.

Embodiment 2

After installing the fixing apparatus to Full-color LBP LASER SHOT [LBP-2040] manufactured by Cannon Co., Ltd, and then outputting image, the durability test was carried out. The pressing force was set to 200 N, the fixing nip is 8 mm×230 mm, the fixing temperature was 200° C., and the process speed was 100 mm/sec. The apparatus using the fixing belts of the Examples 1 to 8 have completed the durability test by printing 100,000 sheets without trouble, while the apparatus using the fixing belt of the comparative example 1 cannot transfer sheet after printing 10,000 sheets and the apparatus using the fixing belt of the comparative example 2 cannot transfer sheet after printing 30,000 sheets, due to the breakdown of the fixing belt.

Embodiment 3

As a result of installing the fixing belt to the apparatus (fixing apparatus 100) employing the belt heating method using the ceramic heater as a heating member as shown in FIG. 7, and executing the idle durability test, it can be confirmed that the heat resistance and the durability are sufficient.

What is claimed is:

1. A fixing belt comprising at least a release layer and a metal layer made by electroforming nickel, wherein said electroformed nickel has a crystal orientation ratio $I_{(200)}/I_{(111)}$ of 3 or more, in which a surface(200) is preferentially grown; and a microvickers hardness thereof is 280 to 450.

2. The fixing belt according to claim 1, wherein said electroformed nickel has a crystal orientation ratio $I_{(200)}/I_{(111)}$ of 8 or more, in which a surface(200) is preferentially grown.

3. The fixing belt according to claim 1, wherein said microvickers hardness of the electroformed nickel is 330 to 420.

4. The fixing belt according to claim 1, wherein said electroformed nickel contains not more than 0.03% by weight of sulfur and carbon element in an amount not less than twice of the sulfur and not more than 0.08% by weight.

5. The fixing belt according to claim 4, wherein the content of the sulfur in the electroformed nickel is not less than 0.0001% by weight.

6. The fixing belt according to claim 4, wherein the content of the sulfur in the electroformed nickel is not less than 0.001% by weight.

7. The fixing belt according to claim 4, wherein the content of manganese in the electroformed nickel is 0.2 to 10 times of that of the sulfur.

8. The fixing belt according to claim 4, wherein the content of cobalt in the electroformed nickel is 0.1 to 5 times of that of the sulfur.

9. The fixing belt according to claim 1, further comprising an elastic layer between the release layer and the metal layer.

10. The fixing belt according to claim 9, wherein said elastic layer is made of one selected from a group consisting of silicone rubber, fluorine rubber and fluorosilicone rubber.

11. An image heating and fixing apparatus comprising a fixing belt and a pair of pressure-contacting members contacted with pressure each other through the fixing belt, an inner side of the fixing belt sliding with one of the pressure-contacting members, the apparatus heating and fixing image on a recording medium by using the heat from the fixing belt, wherein the fixing belt is the one defined in any of the claims 1 to 10.

12. The image heating and fixing apparatus according to claim 11, further comprising magnetic flux generating means for generating magnetic flux, wherein the fixing belt is heated by the magnetic flux generated in the magnetic flux generating means to heat and fix the image on the recording medium.

13. The image heating and fixing apparatus according to claim 11, wherein the pressure-contacting member sliding with the fixing belt is a heating member; and the image on the recording medium is heated and fixed by using the heat from the heating member through the fixing belt.

* * * * *

UNITED STATES PATENT AND TRADEMARK OFFICE

CERTIFICATE OF CORRECTION

PATENT NO. : 6,564,033 B2
DATED : May 13, 2003
INVENTOR(S) : Yaomin Zhou et al.

It is certified that error appears in the above-identified patent and that said Letters Patent is hereby corrected as shown below:

Column 1,
Line 18, “etc.” should read -- etc., --.

Column 4,
Line 61, “grow,” should read -- grown, --.

Column 6,
Line 12, “called as” should read -- such as --.

Column 16,
Line 7, “to” should read -- for --.
Line 22, “defined” should read -- defined as --, and “taking” should read -- taken --.

Column 18,
Line 23, “each” should read -- to each --.

Signed and Sealed this

Eleventh Day of November, 2003

JAMES E. ROGAN
*Director of the United States Patent and Trademark Office*